US011453937B2

(12) United States Patent
Anderson et al.

(10) Patent No.: US 11,453,937 B2
(45) Date of Patent: Sep. 27, 2022

(54) SOLID STATE GRAIN ALIGNMENT OF PERMANENT MAGNETS IN NEAR-FINAL SHAPE

(71) Applicant: Iowa State University Research Foundation, Inc., Ames, IA (US)

(72) Inventors: Iver E. Anderson, Ames, IA (US); Emma Marie Hamilton White, Ames, IA (US); Matthew J. Kramer, Ankeny, IA (US); Aaron G. Kassen, Sinking Springs, PA (US); Kevin W. Dennis, Ames, IA (US)

(73) Assignee: Iowa State University Research Foundation, Inc., Ames, IA (US)

( * ) Notice: Subject to any disclaimer, the term of this patent is extended or adjusted under 35 U.S.C. 154(b) by 0 days.

(21) Appl. No.: 16/974,116

(22) Filed: Oct. 5, 2020

(65) Prior Publication Data

US 2021/0147968 A1 May 20, 2021

Related U.S. Application Data

(62) Division of application No. 15/530,951, filed on Mar. 28, 2017, now Pat. No. 10,851,446.

(Continued)

(51) Int. Cl.

| | |
|---|---|
| ***C22F 1/00*** | (2006.01) |
| ***C22C 21/04*** | (2006.01) |
| ***C22C 21/10*** | (2006.01) |
| ***C22C 21/14*** | (2006.01) |
| ***C22F 1/057*** | (2006.01) |

(52) U.S. Cl.

CPC ..... *C22F 1/004* (2013.01); *C22C 21/04* (2013.01); *C22C 21/10* (2013.01); *C22C 21/14* (2013.01); *C22F 1/057* (2013.01)

(58) Field of Classification Search

CPC ..... C22F 1/004; C22F 1/057; C22C 21/04; C22C 21/10; C22C 21/14

See application file for complete search history.

(56) References Cited

U.S. PATENT DOCUMENTS

| | | | | |
|---|---|---|---|---|
| 3,085,036 A | | 4/1963 | Steinort | 148/31.57 |
| 3,428,498 A | * | 2/1969 | Gunther | C22C 1/04 148/101 |

(Continued)

OTHER PUBLICATIONS

Chu et al. ("Evolution of Fe—Co rich particles in Alnico 8 alloy thermomagnetically treated at 800 deg C". Materials Science and Technology; Sep. 2000; 16, 9; ProQuest Central p. 1023.) (Year: 2000).*

(Continued)

*Primary Examiner* — Anthony J Zimmer
*Assistant Examiner* — Ricardo D Morales

(57) ABSTRACT

Magnet microstructure manipulation in the solid state by controlled application of a sufficient stress in a direction during high temperature annealing in a single-phase region of heat-treatable magnet alloys, e.g., alnico-type magnets is followed by magnetic annealing and draw annealing to improve coercivity and saturation magnetization properties. The solid-state process can be termed highly controlled abnormal grain growth (hereafter AGG) and will make aligned sintered anisotropic magnets that meet or exceed the magnetic properties of cast versions of the same alloy types.

13 Claims, 8 Drawing Sheets

Related U.S. Application Data

(60) Provisional application No. 62/390,513, filed on Mar. 31, 2016.

(56) References Cited

U.S. PATENT DOCUMENTS

| | | | | |
|---|---|---|---|---|
| 4,033,795 | A | 7/1977 | Berry | 148/121 |
| 5,125,574 | A | 6/1992 | Anderson | 239/8 |
| 5,352,301 | A | 10/1994 | Panchanathan | 148/101 |
| 5,368,657 | A | 11/1994 | Anderson | 148/400 |
| 5,372,629 | A | 12/1994 | Anderson | 75/332 |
| 5,520,748 | A * | 5/1996 | Yang | C22C 33/0292 148/104 |
| 5,589,199 | A | 12/1996 | Anderson | 425/10 |
| 5,811,187 | A | 9/1998 | Anderson | 428/403 |
| 6,319,334 | B1 | 11/2001 | Ohashi | 148/101 |

OTHER PUBLICATIONS

Dillon ("Effects of heat treatment and processing modifications on microstructure in alnico 8H permanent magnet alloys for high temperature applications." (2014)). (Year: 2014).*

C.B. Madeline Durnand-Charre et al., Relation Between Magnetic Properties and Crystallographic Texture of Columnar Alnico 8 Permanent Magnets, IEEE transactions on Magnetics, 14, 1978.

N. Makino et al., Techniques to Achieve Texture in Permanent Magnet Alloy Systems, J. Appl. Phys., 36, 1185, 1965.

W.F. Hosford, Mechanical Behavior of Materials, Cambridge University Press, 2009.

A. Higuchi et al., Some Relationships Between Crystal Textures and Magnetic Properties of Alnico 8, IEEE Transactions on Magnetics, MAG6, 218, 1970.

I.E. Anderson et al., H ighly tuned gas atomization for controlled preparation of coarse powder, Hocheistungsgasverdusung fur die gezielte Praparation grober Pulver, Materialwiss Werkstofftech., 41, 504-512, 2010.

* cited by examiner

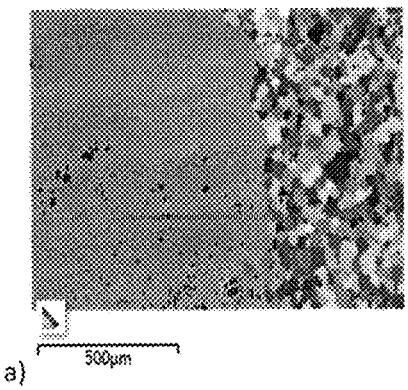
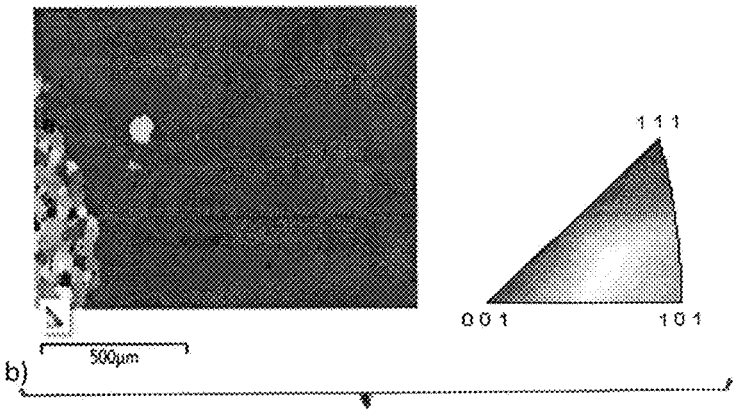
FIG. 12a
FIG. 12b
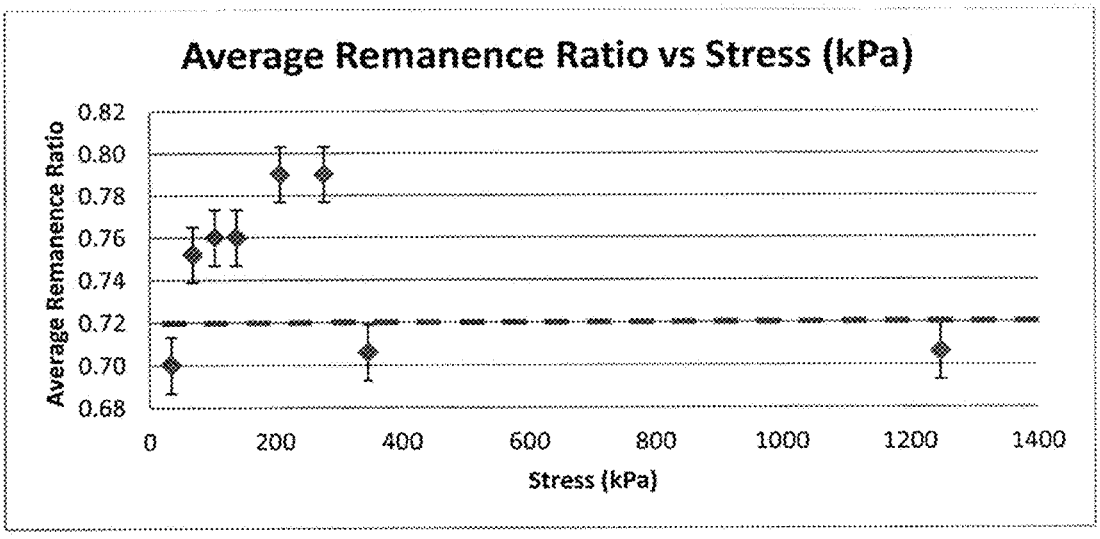
FIG. 13

SOLID STATE GRAIN ALIGNMENT OF PERMANENT MAGNETS IN NEAR-FINAL SHAPE

RELATED APPLICATION

This application claims benefit and priority of provisional application Ser. No. 62/390,513 filed Mar. 31, 2016, the entire disclosure of which is incorporated herein by reference.

CONTRACTUAL ORIGIN OF THE INVENTION

This invention was made with government support under Grant No. DE-AC02-07CH11358 awarded by the Department of Energy. The Government has certain rights in the invention.

FIELD OF THE INVENTION

The present invention relates to heat treatable alloys and to a method of controlling solid state grain alignment in a high temperature annealing step to provide a grain-aligned microstructure.

BACKGROUND OF THE INVENTION

Alnico alloys comprise as major alloying components Al, Ni, Co, and Fe and are widely used in the production of magnets for many applications. Alnico magnets can exhibit anisotropic or isotropic magnetic properties as a result of different processing and chemistry.

Alnico alloys are widely available commercially in various grades, such alnico 8 and 9, that are made by different processing such as powder metallurgy, sintering, or casting.

Complicated labor-intensive directional solidification is the current commercial method for producing grain-aligned alnico 9 magnets with the best existing energy density.

SUMMARY OF THE INVENTION

The present invention involves magnet microstructure manipulation in the solid state by proper application of a controlled stress in a direction during the high temperature annealing in a single-phase region of heat-treatable magnet alloys, e.g., alnico-type magnets. This solid-state process can be termed highly controlled abnormal grain growth (hereafter AGG) and can make aligned sintered anisotropic magnets that meet or exceed the magnetic properties of cast (directionally solidified) versions of the same alloy types.

Practice of the present invention preferably involves use of fine spherical, pre-alloyed powders and final-shape forming techniques including, but not limited to, compression or injection molding and sintering methods to avoid complicated labor-intensive directional solidification that is the current commercial method for producing grain aligned magnets with the best existing energy density.

Achievement of superior magnetic properties is achieved by control and selection of parameters for magnetic annealing and draw annealing that are performed on the aligned magnet microstructure after the highly controlled AGG process to provide the optimum coercivity and saturation magnetization.

Practice of the invention to improve coercivity and saturation magnetization can also involve modified magnet alloy compositions. Generally, highly textured anisotropic alnico magnets made by this invention, along with optimized coercivity and magnetization, can achieve greatly enhanced energy density or maximum magnetic energy product and the capability for high volume manufacturing due to the advantages of powder processing to near-final shapes.

In other embodiments of the invention, the solid-state AGG process is conducted in a manner to make substantially single crystal shapes or bodies of alnico alloys or other alloy systems by powder processing to near-final shapes.

The present invention and advantages thereof will be described in more detail below with respect to certain embodiments of the present invention offered for purposes of illustration and not limitation in relation to the following drawings.

BRIEF DESCRIPTION OF THE DRAWINGS

FIGS. 12*a*, 12*b* illustrate EBSD orientation maps of a longitudinal sample section for axial direction (TD) with accompanying inverse pole figure of near optimal load of 200 grams (227 kPa) using both grain mobility bias and grain rotational effects wherein FIG. 12*a* is the left side of the sample in axial orientation and FIG. 12*b* is the right side of the sample in axial orientation.

FIG. 13 is a graph of average remanence ratio (Br/Ms) versus applied stress (kPa) wherein the dashed line corresponds to the (baseline) 4 h sintered remanence ratio.

FIGS. 15*a* and 15*b* are SEM micrographs of a thermal gradient-treated sample exhibiting AGG, wherein FIG. 15*a* is a longitudinal cross-section and FIG. 15*b* is a transverse cross-section.

DETAILED DESCRIPTION OF THE INVENTION

Figure 1:
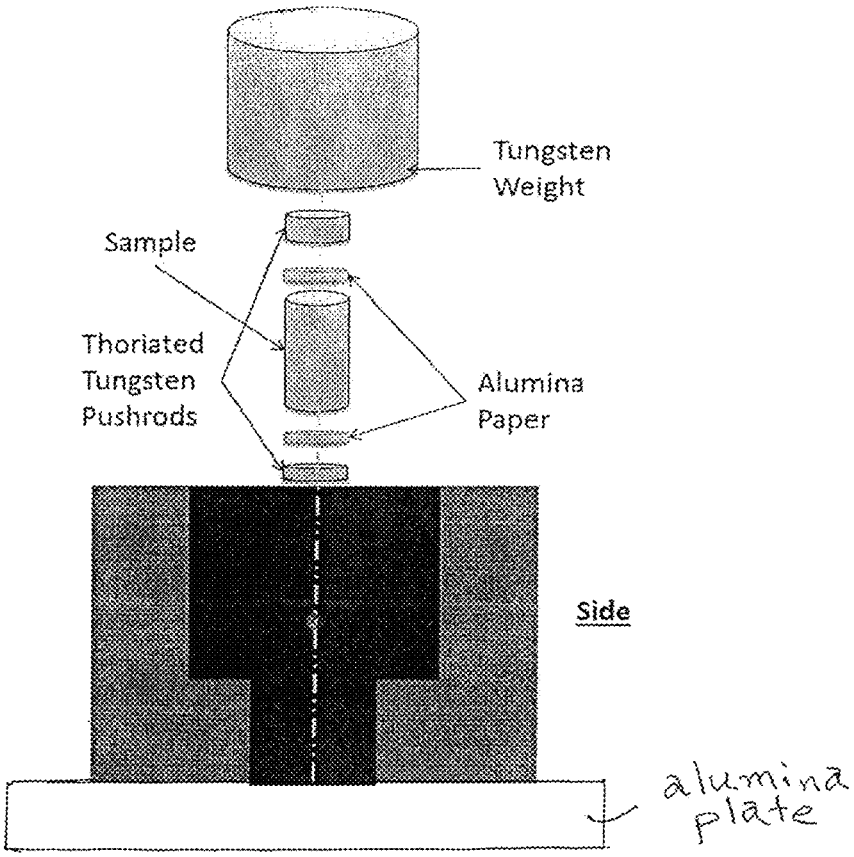
FIG. 1 is a schematic that shows an exploded view, with partial a side view portion, of a uni-axial loading apparatus used to texture rod-shaped alnico samples using a compression load. The apparatus employed a tungsten weight, thoriated tungsten pushrods, alumina paper insulating discs between the sample and the pushrods, and a machinable alumina support body (partial side view). The apparatus rests on an alumina ceramic support base shown.

An illustrative method embodiment of the present invention begins with forming final-shape magnets by compression or injection molding from fine, pre-alloyed powders that promote rapid sintering to a fine-grained equiaxed starting microstructure with a density of greater than about 98% of theoretical density, i.e., essentially full density. The present invention is applicable to alloys comprising the aluminum-nickel-cobalt-iron type permanent magnet alloys having a body centered cubic crystal structure, such as alloys commonly referred to as alnico alloys, an illustrative one (alnico 8) of which can include (wt. %) 7.1% Al, 13.0% Ni, 40.1% Co, up to 3.0% Cu, up to 6.5% Ti, up to 0.5% Nb, and balance substantially Fe and incidental impurities. Such alnico alloys include, but are not limited to alnico 5, 5-7, 8 and 9 alloys. Although the Examples set forth below employ alnico 8 alloy samples, alnico 8 alloy is employed for purposes of illustration of the invention and not of limitation. In certain embodiments, Alnico alloys can have a composition, in wt. %, of about 7 to about 8% Al, about 13 to about 15% Ni, about 24 to about 42% Co, up to about 3% Cu, up to about 8% Ti, and balance Fe and incidental impurities.

Although not preferred, a fine-grained chill casting can also be used as the starting magnet shape, but the driving force for grain growth will be diminished because of a 5×-10× increase in grain size compared to the powder processed approach. Also, the need for an individual mold for each casting provides a barrier to mass production that is avoided by the powder-based method. It is also preferred that the starting powder for the initial molded magnet shapes have an extremely thin (typically) oxide surface coating to promote rapid sintering and to minimize the effectiveness of any oxide pinning sites (that arise from breakup and coarsening of the oxides on prior particle boundaries) that could inhibit grain growth during the practice of this technology. Such powders can be made by close coupled, high-pressure gas atomization or other gas atomization processes. However, the fine-grained microstructure of a chill casting, although not preferred from a driving force standpoint, may have a lower content of internally dispersed oxide particles, which is preferred to minimize pinning sites that inhibit grain growth.

The dimensions of the die set used to form (mold) the magnet shapes from a mixture of powders, solvent and binder is designed with a uniform dilation to account for solvent and binder removal, as well as the proper densification shrinkage to near-final magnet dimensions. It is in this condition that the next stage of microstructure control pursuant to the present invention will be exercised. Also, it is noted that there is a need in the molding die for some additional minor dimensional inflation to account for any small losses from final grinding of the surfaces.

Although rod-shaped magnet shapes are described in the Examples set forth below, the present invention can be practiced in connection with various other magnet shapes of commercial interest to impart a grain-aligned microstructure.

The next step of the illustrative method embodiment involves heat treating the molded magnet shape or body with an applied stress in a direction at an annealing temperature where a single phase exists and for a time that imparts an aligned microstructure. For purposes of illustration and not limitation, a dead weight load can be applied to a rod-shaped magnet shape, as shown in FIG. 1 and described in Examples 1, 2, and 3 to apply uni-axial stress. The dead weight load can apply a compressive load as shown in FIG. 1, although applying a tensile load also is envisioned depending upon the particular magnet shape. Moreover, uniaxial loading can be applied by other devices that can apply a compressive (or tensile) load, such as including, but not limited to, a servo-hydraulic mechanical press in a load control mode. Alternately, in another illustrative embodiment of the invention, a thermal gradient can be established in the magnet shape or body in a manner to apply a stress in the direction (e.g. uni-axial stress) as described in Example 4.

Selection of a sufficient dead weight load (or constant stress) is made so that the stress can be high enough to effectively initiate and bias the crystallographic direction of the desired abnormal grain growth (AGG) that is driven throughout the volume of the magnet shape. In one illustrative embodiment of the invention, the dead weight load produces substantially zero strain in the magnet shape as described in Example 2 and should not be too high so that nucleation and propagation of macroscopic slip planes cannot be avoided which can rotate growing grains to a non-preferred direction. Keeping the dead weight load below a certain maximum can also minimize any plastic deformation of the sample that can distort its shape significantly away from the intended dimensions. In another illustrative embodiment of the invention, the dead weight load can be just high enough to propagate slip planes such that a combination of solid state AGG and some grain rotation toward the preferred direction occurs, as described in Example 3 below, but not high enough to rotate the grains out of the preferred direction.

The direction for application of the load is dependent on the basis of the desired final magnetization direction for each application, i.e., when subjected to subsequent magnetic annealing (MA), the crystallographic alignment must be parallel (or near-parallel) to the magnetization direction of the external field to achieve the maximum sustained coercivity effect, especially in alnico-type magnets that rely on shape anisotropy for a major part of their coercivity. According to the present invention, a cubic crystal structure, e.g., the high temperature B2 phase of an alnico alloy, can be biased to grow in a direction normal to the axis of the applied load. Although it is still possible to grow grains that are oriented at different radial directions to the load axis, this invention involves on a confinement effect provided by the exterior of the magnet shape to promote selection of a single direction for grain growth that is close to the ideal. It is also possible to further promote preferred alignment by use of a crystalline epitaxial seed (e.g., a wafer of directionally solidified Alnico 9) along the interface between the load and the magnet exterior surface, where an epitaxial matching effect can be utilized if the interfaces are prepared properly (polished) to achieve at least partial diffusion bonding.

Full density is important in the starting fine grain equiaxed microstructure to permit the fixed stress vector of the applied load to be transmitted without dissipation (from collapsing of void concentrations) throughout the entire volume of the magnet shape. The fine grain size facilitates enhanced grain growth kinetics and to increase the probability of selection of a preferred direction for abnormal grain growth for maximum magnetic properties. Selection of the proper temperature for this grain growth process is linked to the operating phase diagram for these typically complex magnet alloys (e.g., alnico 8) and the need to be within a high temperature single phase region of the alloy (e.g. the B2 phase region) to promote uniform composition and rapid diffusional mobility of the grain boundaries without obstruction from secondary phases. If the temperature is too low, it may be possible to accomplish the controlled AGG process, but the time needed for completion could be too long for practical processing. The time required for completion of the AGG process of this invention must be determined for each magnet shape and size although the kinetics of the process are similar for a given magnet alloy and starting microstructure since the AGG process must consume the entire volume of the magnet in the course of the treatment. The time is sufficient when grain growth has eliminated the vast majority of the initial fine grains, promoting either a single crystal (monocrystalline) magnet shape or a polycrystalline magnet shape in which only greatly enlarged grains (mm-sized) remain that are all aligned within a small angular mismatch of the ideal crystallographic direction for maximum magnetic properties, especially remanence ($B_r$) and squareness of the hysteresis loop.

An additional advantage of the completed AGG magnets that must be mentioned is the ability to use a moderate cooling rate on the samples following AGG; i.e., the need to quench from the B2 phase solutionizing temperature to avoid excessive gamma phase formation (that forms preferentially on grain boundaries in Alnico 8 and 9) is eliminated since nearly all of the grain boundary area has been eliminated. A reasonable attempt should be made to accelerate cooling through the spinodal transformation temperature range to prevent full formation of the final partitioned microstructure, since the spinodal transformation will be completed to the desired nanostructure dimensions during subsequent magnetic annealing.

As mentioned, to permit the maximum level of magnetic properties to be achieved in a magnet shape that has been fully processed by the highly controlled solid-state AGG process of this invention, the magnetic annealing process and the subsequent draw annealing process must also be properly performed wherein draw annealing involves heating at a temperature 200° C. or so below the magnetic annealing temperature with the electromagnetic field turned off, as is known in the art. These process steps need to be performed with the selected parameters that had been previously determined to maximize the coercivity ($H_{ci}$) and saturation magnetization ($M_{sat}$) of the specific magnet alloy.

Each specific magnet shape and size may have a unique set of thermal treatment parameters, again because of the different volume of the magnet since thermal diffusivity (conductivity) will affect the ability to achieve a desired uniform temperature. At least the full density of the AGG aligned magnets permits simple computation of the adjustments needed to vary the thermal treatments after thermal diffusivity measurements have been made on samples of post-AGG magnets.

The following Examples are offered to further illustrate, but not limit, practice of an embodiment of the invention.

EXAMPLES

Experimental Procedure for Powder Processed Samples High commercial purity (99.99%) elemental additions were melted and atomized to create a (slightly modified) alnico 8 based pre-alloyed powder using a close-coupled gas atomization system (U.S. Pat. No. 5,125,574 and reference 1) with a desired composition of: 7.3 Al-13.0 Ni-38 Co-32.3 Fe-3.0 Cu-6.4 Ti (wt. %). The 3,500 g charge was melted, homogenized, and superheated to a temperature of 1625° C. before pouring and atomizing with high purity argon gas at 2.93 MPa (425 psi) of supply pressure. The resultant powder was riffled and screened from −106 μm and down using standard ASTM size cuts and a representative sample was sent for chemical analysis (NSL Analytical), which verified the desired composition within 0.1% for all alloy components. Laser diffraction particle size distribution analysis (Microtrac®) was used to characterize the powder and SEM (JEOL 5910) analyzed the final powder shape and "satellite" content.

Two size cuts from the resulting powder were combined to make each 100 g powder blend, i.e., 90 wt. % 32-38 μm+10 wt. % 3-15 μm. This powder was mixed in a multi-axis (TURBULA®) blender and compounded by mortar and pestle with a low-residual impurity polypropylene carbonate (PPC) binder (QPAC® 40) that had been dissolved in acetone to create a 6 wt. % solution for compounding. This created a final loading of 2.6 vol. % binder in the final blend that was allowed to dry in air to evaporate excess acetone for 24 hours.

Each sample, containing 4.3 g of the compound, was pressed in a 9.525 mm diameter die at 156 MPa. Each resultant green body underwent a two stage debinding procedure in air with isothermal holds to decompose the PPC binder at 180° and 300° C., followed by a furnace cool to produce a brown body for sintering. Debinding temperatures were determined for the PPC binder by differential, scanning calorimetry to identify decomposition behavior, with 180 degrees selected to ensure the slowest possible decomposition. This allowed retention of the initial open porosity in order to facilitate complete decomposition and outgassing by the time the sample reached 300° C. to avoid trapped gas porosity.

Figure 2:
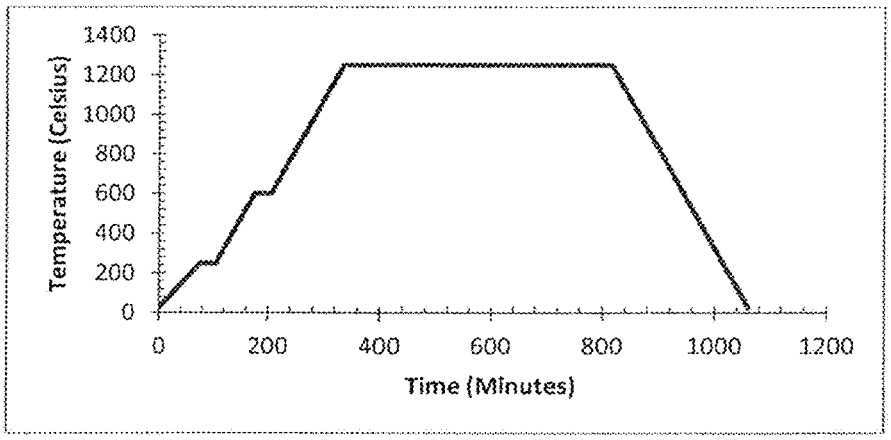
FIG. 2 is an exemplary sintering curve for the samples of illustrative examples.

Each brown body was sintered, FIG. 2, using a three-stage sintering curve with preliminary holds at 250° and 600°, along with final sintering at 1250° C. (within the single phase solid solution region for this alloy) for 1 to 12 h and slowly cooled (furnace power turned off) under a vacuum of approximately $5(10^{-6})$ torr to produce a uniformly densified compact. The preliminary holds at 250° C. and 600° C. ensured removal of any residual binder in an open porosity state before surface access was sealed by densification during isothermal sintering at 1250 C. Zirconium turnings were placed around the sample as gettering material for any furnace outgassing species and the sample was covered loosely by an alumina crucible to shield it from deposition of other possible contaminants from furnace surfaces.

Sample rods underwent further heat treatments that had been developed in our laboratory for very similar alnico alloys to establish the appropriate nano-structure for full development of magnetic properties. First, each rod was subject to a "re-solutionizing" heat treatment at 1250° C. under a vacuum of at least $5(10^{-6})$ torr for 30 minutes to "reset" the microstructure to a B2 phase solid solution and quenched in silicone oil to room temperature to retain as much of the solid solution as possible. Samples were solvent cleaned and sealed in quartz under vacuum and subject to magnetic annealing under a 1 Tesla field at 840° C. for 10 minutes to promote aligned spinodal transformation. Annealing ("draw") cycles were performed in an air atmosphere furnace at 650° C. for 5 h and 580° C. for 15 h to produce a fully heat treated condition (FHT) for each sample.

Magnetic measurements of the FHT specimens were performed using a closed-loop Laboratorio Elettrofisico AMH-500 hysteresigraph under a maximum applied field of 15kOe. FE-SEM analysis, using an Amray 1845 or, later, an FEI Quanta 250, both fitted with electron backscattered diffraction (EBSD) systems, was performed to confirm the grain size and analyze the microstructure of each final sintered and FHT sample.

TABLE 1

Magnetic properties of sintered alnico specimens at various times, compared to a standard Alnico 8 magnet.

| Sample | Br G | Hci Oe | BHmax MGOe | Remanence Ratio Mr/Ms |
|---|---|---|---|---|
| 1 h Sinter | 8,523 | 1,632 | 4.87 | 0.72 |
| 4 h Sinter | 8,789 | 1,685 | 5.04 | 0.75 |
| 8 h Sinter, Sample 1 | 10,052 | 1,688 | 6.5 | 0.85 |
| 8 h Sinter, Sample 2 | 9,725 | 1,735 | 6.4 | 0.83 |
| 12 h Sinter | 8,626 | 1,645 | 4.85 | 0.73 |
| MMPA Std 8HC Sintered | 6,700 | 2,020 | 4.5 | — |

The improved properties of the two 8 h (h=hours) sintered samples, especially the magnetic remanence and remanence ratio values, indicated that abnormal grain growth and an enhanced texturing effect was occurring within these samples. Specifically, it is understood that improved magnet texturing can enhance remanence and thus remanence ratio dramatically, which can lead to increased energy product and improved hysteresis loop shape. This is often reported as the Mr/Ms or remanence ratio value, which for a typical unaligned equiaxed alnico is typically on the order of 0.72. However, in the 8 h samples of Table 1, the remanence ratio was observed to be much higher, 0.83-0.85 showing it was likely that some amount of grain alignment must have occurred. Remanence ratios for highly aligned magnets, such as directionally solidified alnico 9, can reach as high as 0.90 or higher, depending on the quality of the casting. Lastly, unlike what might be expected typically in permanent magnet systems, coercivity appears to be independent of grain size in the samples in this experiment.

Figure 3:
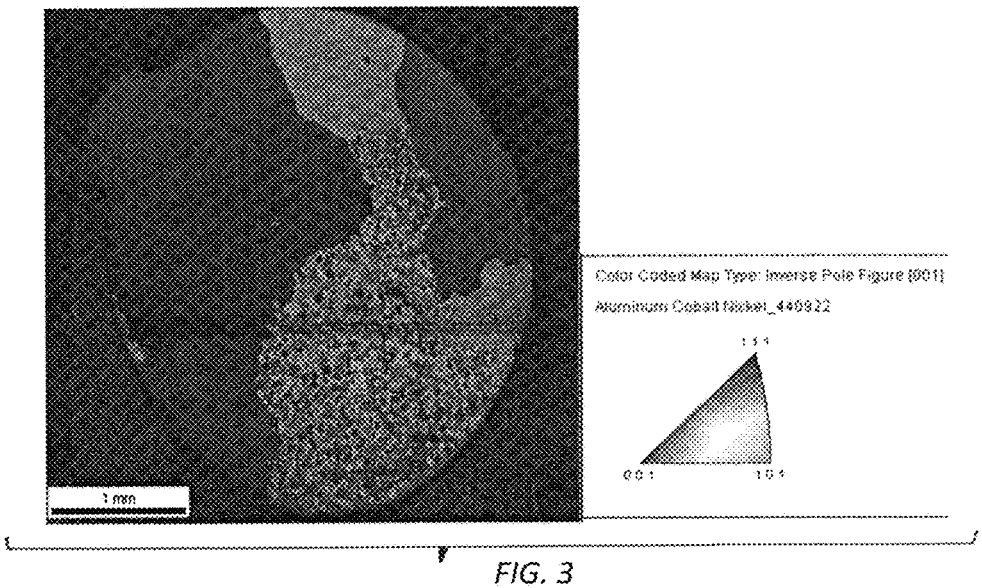
FIG. 3 is a transverse EBSD (ND) section image with accompanying inverse pole figure of an 8 hour sintered sample showing significant preferential grain orientation. EBSD is electron backscattered surface diffraction and ND is normal direction.
Figure 4:
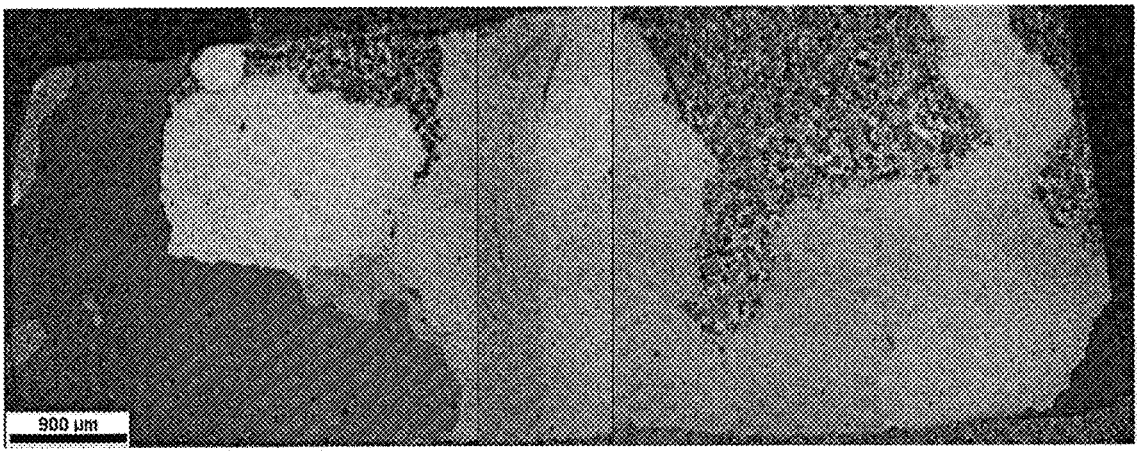
FIG. 4 is a longitudinal EBSD (ND) section image of the 8 hour sintered sample as a mosaic of three images combined to show the total sample area.

To verify that alignment had occurred by a grain growth mechanism, as suggested by the magnetic properties and SEM results, EBSD analysis was performed on the polished transverse (FIG. 3) and longitudinal (FIG. 4) sections of one of the 8 h sintered rods. Analysis of the EBSD results clearly showed that the transverse section was populated heavily by large grains, many of which were oriented preferentially near the <111> orientation to the sample normal direction (ND). Secondarily, a significant portion of equi-axed randomly oriented grains remained, covering approximately ⅓ of the sample surface. The longitudinal section also showed significant areas of the sample oriented near the <101> and <001> directions to the sample ND. Further analysis on the tilt direction (TD) of the longitudinal section sample, parallel to the long axis of the sample, showed that approximately 20% of the sample was aligned on an <001> direction, within a maximum of 15 degrees off-axis. This is close enough to optimal <001> that significant contributions to the final energy product would still be realized over the baseline magnet. Thus, it was concluded that "accidentally" aligned abnormal grain growth was observed in at least 2 samples after sintering beyond 4 h and that this provided magnetic property benefits. It was concluded that the 4 h sintered (99.6% dense) condition could provide an excellent starting condition for production of highly aligned magnets with further improved magnetic properties, if control could be exercised over the solid-state grain growth process to align it in a preferred crystallographic direction.

Constant Uni-Axial Stress Approach for Textured Abnormal Grain Growth

To confirm that the abnormal grain growth phenomena could be controlled, a group of alnico 8 powder processed samples in the as-sintered 4 h condition were utilized in texture development experiments. These samples were placed into a machinable alumina fixture, as shown in FIG. 1 to insure that uniform uni-axial stress is applied (by a dead weight) to samples during resumed sintering at 1250° C. under vacuum for another 4 h cycle using the same heating profile followed by furnace cooling.

Figure 5:
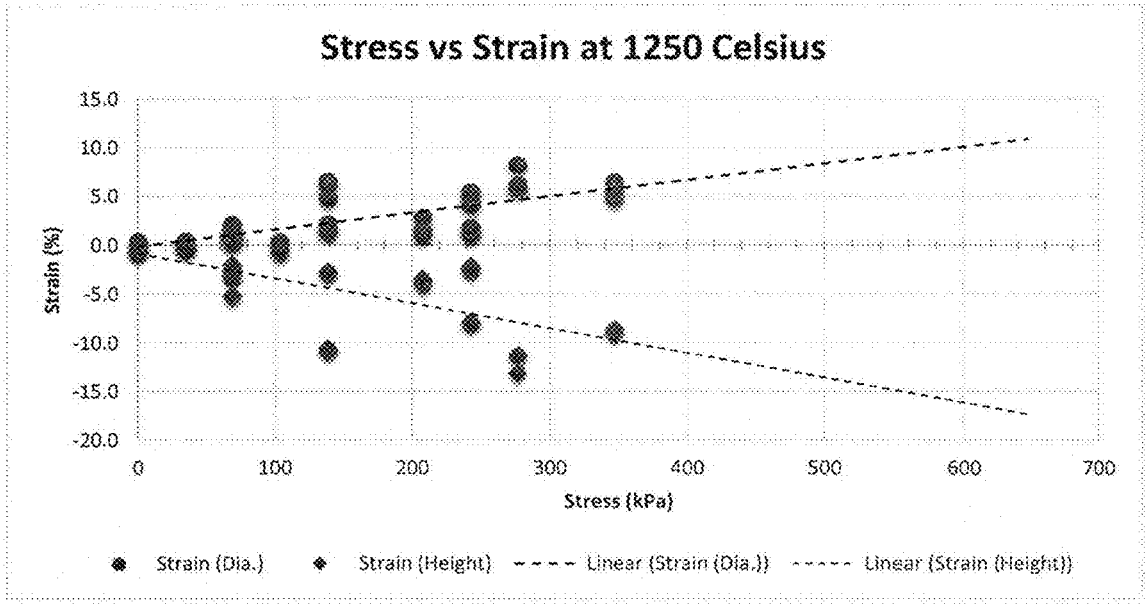
FIG. 5 is a graph of the predicted point of zero strain for sintered alnico at 1250° C.

Using the fixture to ensure a uni-axial stress condition in a 3 mm dia.×10 mm height specimen, deadweight loads of up to 900 g (1,248 kPa) and 250 g (345 kPa) or less were applied along the longitudinal axis of the specimens within a vacuum furnace that was held for 4 hours at a temperature of 1250° C. Any resulting plastic deformation, or shear/creep, was measured as growth of the diameter and shrinkage of the height of each specimen and was either allowed to progress through the entire isothermal sintering treatment, i.e., for samples of 345 kPa stress or less, or to progress to a maximum strain value fixed by the dimensions of the fixture, i.e., for the samples stressed at 1,248 kPa. The results for plastic deformation of the set of specimens as a function of loading through the entire isothermal sintering treatment are shown in FIG. 5. From the observed results where the trend of decreasing percent strain with reducing loads was consistently decreasing toward 0.0%, it was apparent that near zero specimen creep was likely to occur at stresses of approximately 35 kPa or less.

Example 1. Heavy Load (Significant Strain) Case

Figure 6:
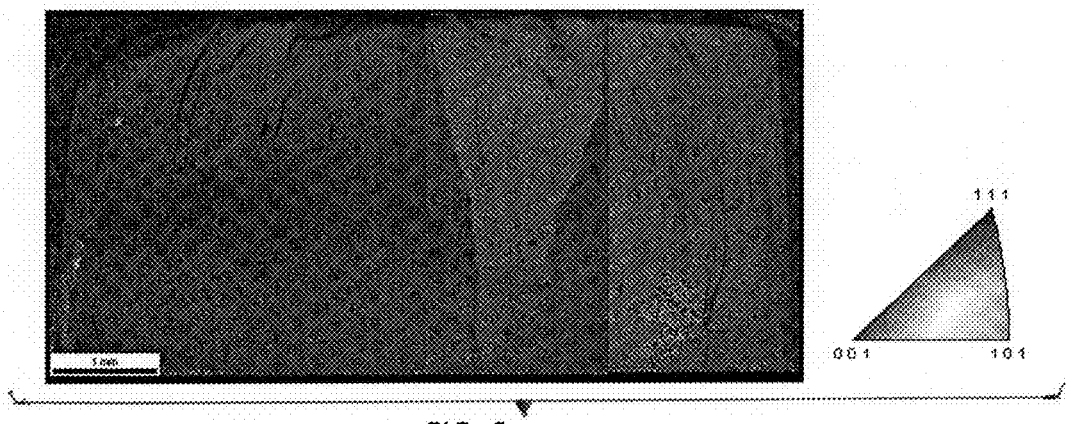
FIG. 6 is a normal direction EBSD image of a longitudinal section with accompanying inverse pole figure for a sintered rod (1250° C.) subject to a 900 g (heavy) load.

Samples that experienced significant plastic deformation due to a high stress from a "heavy" dead weight stress, greater that about 100 kPa, were subject to magnetic annealing and draw annealing cycles to reach the FHT condition and their magnetic properties were measured. Subsequently, cross-sections were cut in the longitudinal and transverse directions to observe the resultant microstructure. Strains from plastic deformation were observed readily in these samples of approximately −11% in the height and 19% in the diameter, promoted by a 1,248 kPa stress during the grain growth experiment at 1250° C., and an apparent texture was observable by EBSD in the greatly enlarged grains. Due to the size of the sample, a series of three EBSD micrographs were utilized to characterize the entire sample and combined to form a mosaic image in FIG. 6. The obvious texture tendency for the specimen towards a <111> orientation along the central axis was apparent, with approximately half of the sample at the ideal <111> direction and the rest of the sample closely approaching this orientation (FIG. 6). The grains which were not fully <111> in orientation resulted from grains that had not completely undergone grain rotation to align the slip plane fully with the compressive axial direction. However, complete rotation could occur with sufficient strain and time.

Figure 7A:
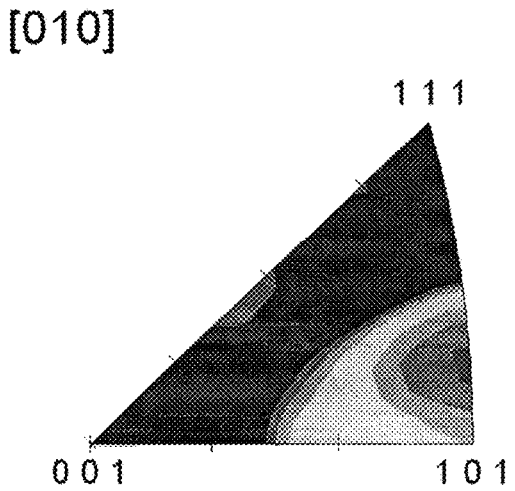
FIGS. 7*a* and 7*b* show inverse pole figures of the tilt direction (TD), FIG. 7*a*, and normal direction (ND), FIG. 7*b*, of the sample showing significant orientation preference.
Figure 7B:
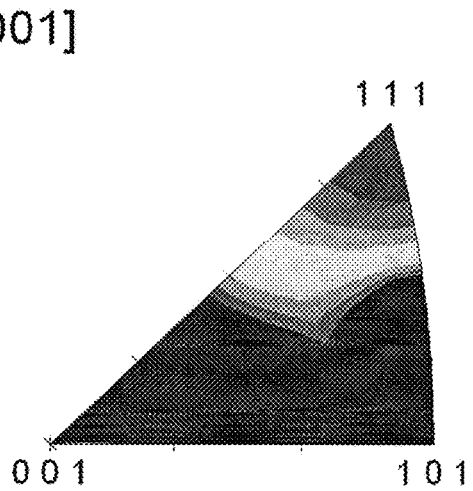

When inverse pole figures (IPF) were created for the center image of the mosaic, it was observed that the slip plane normal appears to be aligning itself parallel to the compressive stress direction (FIG. 7*a*, 7*b*). This confirms that a grain rotation effect is likely to be playing a role in what texture is evolved during shear/creep and grain growth within the samples with significant plastic deformation from a heavy deadweight load. This also confirms that under an applied stress in a corrected direction (not the one used in this experiment), effective control of the final orientation should be possible to achieve to promote abnormal grain growth along the central axis of a cylindrical magnet in the preferred easy direction in Alnico of <001>.

Figure 8:
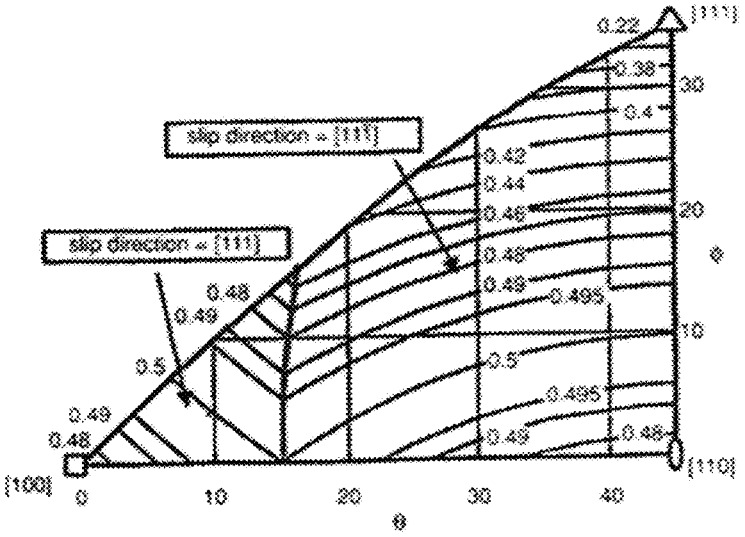
FIG. 8 is a plot of Schmidt factor isopleths for the BCC (body centered cubic) system in an inverse pole figure unit triangle.

This is further confirmed when considering the Schmidt factors which would be expected to be observed in a BCC slip system (like the B2 phase at 1250° C.) undergoing <111> pencil glide in compressive loading. Where grain rotation is a significant factor, the slip direction being utilized will ultimately determine what plane(s) should be observed in the perpendicular and parallel directions with respect to the compressive axis. Shown in FIG. 8 for an axisymmetric condition, when isopleths are calculated for the various slip directions activated in the BCC system, there is a tendency for grain rotation to drive the final orientation towards either the <111> or <100> orientation, depending on which slip direction has been activated in order to reduce the resolved sheer stress.

Figure 9:
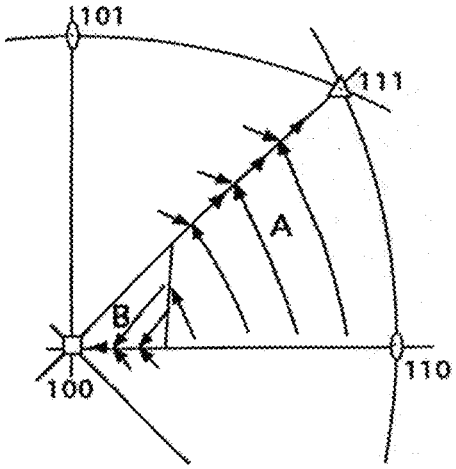
FIG. 9 shows rotational directions for BCC alloys subject to compressive loads that are undergoing <111>-pencil glide.

The net result of the rotations shown is that grain rotation should always occur under high compressive loads and that this rotation is always away from the slip direction during pencil glide. Thus, in this example, the rotations under high load would consistently and predictably be always in region A, away from [111] towards [111]. This is graphically represented in the image in FIG. 9 from Hosfords text. [reference 4]

Hysteresigraph measurements performed after MA and FHT provided insight on how the resulting texture in this example caused by solid-state creep deformation that promoted grain growth based texturing influenced final magnetic properties. A comparison to the isotropic 4 h sintered case that exhibited values of remanence ratio (0.75) in Table 1, indicated that the plastically deformed and textured samples in Table 2 were slightly below what would be considered typical for the previous equi-axed fine-grained alnico, having an average of remanence ratio of 0.71. Since it was observed that axial orientation was typically aligning with respect to the normal of the slip planes, this meant that the orientation of the magnetization easy axis with respect to the axial direction was not close to the optimal of <001>. For instance, in the case of the <011> direction, this orientation is approximately 45 degrees off-orientation, assuming the magnetic easy direction is equivalent in all <001> directions, giving the worst possible situation for cubic symmetry. Thus, for heavy deadweight loads, a method to change the loading direction to force the abnormal grain growth direction to align with the central axis of the magnet would achieve a dramatic improvement in alignment of the magnetic easy axis direction of the magnet.

Example 2. Light Load (Near-Zero Strain) Case

One thing to note in both heavy and lightly loaded cases for these sintered powder samples in a post-grain growth condition is that the final coercivity values were high in about half of the cases, when compared to previous results for fine grained cast samples. Specifically, a coercivity of 1810 Oe was achieved with a 250 g (heavy) load, on par with what is typically observed in a cast magnet for this same alloy. Also, this increased coercivity (shown in Table 2) without a decreased remanence indicates that realizing improved texture should grant improved energy product without significantly impacting coercivity. This is consistent with pinning mechanisms in alnico, where spontaneous magnetization combined with domain wall surface energy are the two dependent quantities for establishing coercivity, without any contribution from magnetic remanence.

TABLE 2

Average magnetic properties vs. applied uni-axial compressive stress during 4 h sintering at 1250° C. of Alnico 8.

| Weight (g) | Stress (kPa) | Br (kG) | Hci (Oe) | BHMax (MGOe) | Remanence Ratio (Mr/Ms) |
|---|---|---|---|---|---|
| 900 | 1248 | 8.41 | 1610 | 4.34 | 0.71 |
| 250 | 347 | 8.24 | 1684 | 4.46 | 0.71 |
| 200 | 277 | 9.34 | 1638 | 5.59 | 0.79 |
| 150 | 208 | 9.35 | 1588 | 5.19 | 0.79 |
| 100 | 139 | 8.84 | 1633 | 4.86 | 0.76 |
| 75 | 104 | 9.0 | 1625 | 5.02 | 0.76 |
| 50 | 69 | 8.78 | 1658 | 5.11 | 0.75 |
| 25 | 35 | 8.12 | 1583 | 4.28 | 0.70 |
| MMPA STD ALNICO 8HC | — | 6.7 | 2020 | 4.5 | — |

Investigations also were performed on "lightly loaded" (<100 g) deadweight samples that were not significantly plastically deformed or subject to creep deformation. These samples were studied to observe the effect of biased grain growth from utilizing the light deadweight to preferentially raise the grain boundary energy in a direction normal to the central sample axis, without inducing any plastic flow. When these samples were loaded with sub-100 g loads, properties for these specimens started to show improved values over typical isotropic alnico, indicating that enhanced texturing was likely to have occurred in these specimens. The 50 g specimens specifically showed remanence ratios as high as 0.77-0.78, higher than what would be typical for specimens that were random equi-axed sintered alnico (remanence ratio of 0.75). It is certainly true that the lightly loaded samples had superior remanence/saturation ratio values, compared to the heavily loaded samples; since the loading direction for the high stress case was not corrected to account for the plastic flow effects on grain rotation (see above).

Figure 10:
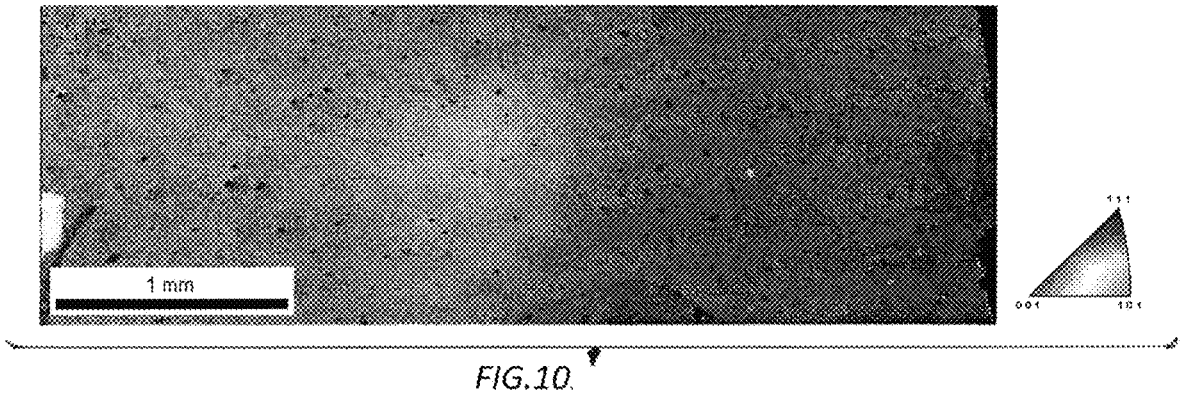
FIG. 10 is a normal direction EBSD image of a longitudinal section of a sintered rod for a 75 g (lightly) loaded sample.
Figure 11A:
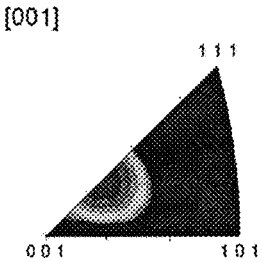
FIGS. 11*a* and 11*b* show sample inverse pole figures of the tilt direction (TD), FIG. 11*a*, and normal direction (ND), FIG. 11*b*, showing beneficial orientation preference for the 75 g lightly loaded sample, approaching the <001> direction.
Figure 11B:
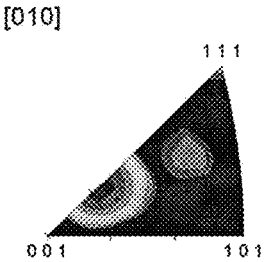

When analysis of the low strain/no strain samples is performed, a notably different texture preference has been observed experimentally, where a nearly uniform orientation approaching the preferred ideal <001> is observed in the microstructure in FIG. 10. This change in driving force for oriented growth at the grain boundaries instead seems to prefer to select orientations which are close to a <115> preference, as can be interpreted from the inverse pole figures of FIGS. 11*a*, 11*b*. Further, this is also indicative of the increased remanence ratio, which was observed for the 75 g sample, and is what would be expected as the samples orientation approaches the ideal <001>.

Example 3. Near-Optimum Load Blended Effect

Through optimization of the applied uniaxial stress condition, utilization of the effects found in examples 1 and 2 can be used to yield yet a third distinct possible texture. This lower applied stress relies on a combination of the example 2 resultant grain boundary biased texture of <115>, but also the plasticity induced rotation effect of the large loads as seen in example 1 to cause a final rotation of the orientation towards a final orientation of near <001>, or importantly, below the fifteen-degree threshold to achieve improved properties in final magnets. Effectively, this modified but optimized loading allows a preferential selection of the activated slip direction, effectively moves us into region B of FIG. 9, where Schmidt factors activate a separate slip direction of <111> type under compression causing a final rotation of grains towards [100]. The result is a texture which is more closely aligned to the preferred magnetic easy direction of the <001> type, as is seen in FIG. 12*a*, 12*b*, where [001] and near-[001] grains are observed on both ends of the magnetic alnico 8 sample, separated by a residual equiaxed zone.

Further investigation, by using a series of loadings has shown that a possible maximum remanence ratio occurred in samples with 200-300 kPa of uni-axial compressive stress, FIG. 13, with large reductions in properties occurring with loads significantly above the apparently optimal conditions. Thus, for stress in excess of about 300 kPa, the mechanism returns to the regime of example 1, where plastic deformation dominates the grain growth texturing mechanism, and we see the corresponding change in magnetic properties, as a decrease in remanence ratio. Conversely when loads are reduced, a slower diminishing effect is seen on the resultant remanence ratio. This leads to the conclusion that reduced stress from the optimum moves towards an area of no effect. In this case, plastic strains are so small, that the sample eventually exhibits the near-[115] final orientation of example 2.

Examination of the resulting average properties from alnico 8 samples, which underwent uniaxial compressive loading at values from approximately 277 kPa to 208 kPa, showed enhancement of parameters that is well over the 4 h sintered isotropic magnet and is typically related to texture development (Table 2). Increases in both remnant magnetization and remanence ratio were observed, with a corresponding enhancement of energy product, as expected. Intrinsic coercivity appeared to show no response to this type of heat treatment, typical for the alnico alloy.

The following Example 4 is offered as another illustrative embodiment to generate a well-aligned large grained magnet from alnico magnet alloys that continues to use the "Constant Uni-axial Stress Approach for Textured Abnormal Grain Growth". However, the constant uni-axial stress is provided by a temperature gradient due to the difference in thermal expansion coefficient, rather than a dead weight loading that is described above. Both this example (below) and the previous examples (1-3) start with the same equiaxed fine-grained alnico 8 samples that had been compression molded, de-bound, and vacuum sintered at 1250° C. for 4 h and slowly cooled.

Example 4. Seeding and Thermal/Stress Gradient Embodiment

Each compression molded (⅜ in. die) and sintered (4 h, 1250° C.) powder sample was subjected to a thermal/stress gradient within the critical secondary recrystallization range. For this example, the sintered alnico 8 sample (designated "8" in FIG. 14) was pre-joined by vacuum diffusion bonding (in a molybdenum screw die set at 1225° C. for 4 hours) to an alnico 9 disk (designated "9") to epitaxially seed the abnormal grain growth (AGG) grain orientation of the sintered alnico 8 powders.

Figure 14:
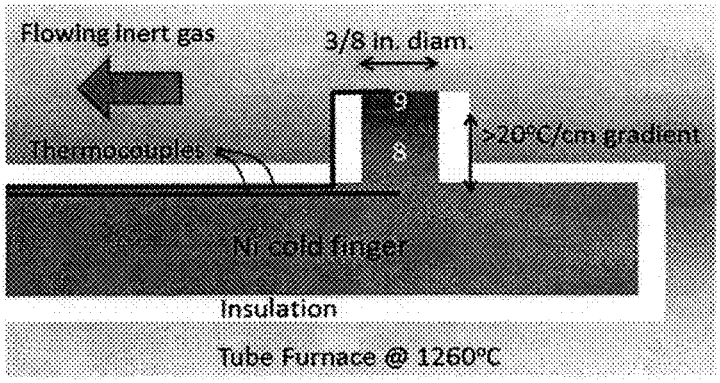
FIG. 14 is a schematic diagram of uniaxial loading apparatus that establishes a thermal gradient to apply a uni-axial stress and resulting AGG in the sample according to another embodiment of the invention.
Figures 15A, 15B:
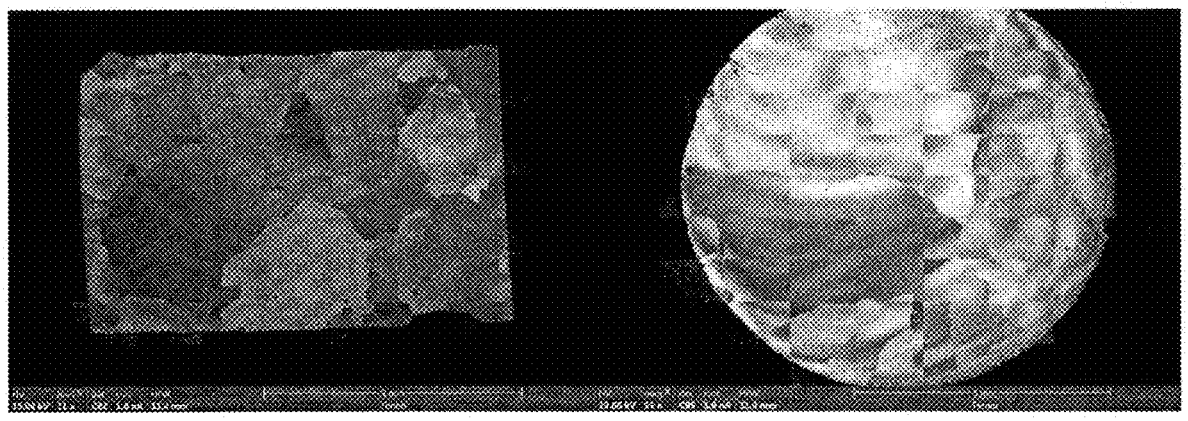

This joined sample was placed in a tube furnace on a water-cooled cold finger with the goal of achieving a >20° C./cm axial gradient across the sample with the entire sample above 1250° C., as shown in FIG. 14. Thermocouples (thick black lines in FIG. 14) monitored the temperatures on both ends (top/bottom) of the sample and with an optimized furnace controller, the sample of this example achieved 1250° C. at the cold finger end (bottom) with 1280° C. at the furnace end (top) of the sample, resulting in a 30° C./cm gradient. Cylinders of 3 mm (dia.) by 8 mm (height) were machined from the larger sample and underwent the same solutionizing, magnetic annealing and draw annealing heat treatments as previously described for examples 1-3. SEM micrographs (FIGS. 15*a*, 15*b*) of the sample analyzed for this example showed complete AGG throughout the width and height of the sample.

Properties for these specimens started to show improved values over typical isotropic alnico 8, indicating that enhanced texturing likely occurred in these specimens, as shown in Table 3. The second set of samples specifically showed remanence ratios as high as 0.76. These values are clearly higher than typical values for specimens of isotropic sintered alnico (0.72). It also is true that the initial samples had good remanence/saturation ratio values, compared to their sintered counterparts, showing the beginnings of developing an underlying texture. An even greater remanence/saturation ratio would be expected as the grain orientation of the sample approaches the ideal <001> texture and fully realizing this improved texture should grant an even further improvement in energy product without impacting (decreasing) coercivity.

TABLE 3

Magnetic properties for two thermal gradient experiments of alnico 8 samples exhibiting AGG, where this example is for the "second" sample.

| Sample | Mr (kG) | BHmax (MGOe) | Hci (Oe) | Mr/Ms |
|---|---|---|---|---|
| First - 1 | 8.8 | 4.89 | 1701 | 0.73 |
| First - 2 | 8.6 | 4.67 | 1705 | 0.71 |
| First - 3 | 8.0 | 4.15 | 1672 | 0.69 |
| Second - 1 | 8.9 | 5.3 | 1580 | 0.76 |
| Second - 2 | 8.3 | 4.5 | 1580 | 0.72 |
| MMPA sintered alnico 8 | 6.7 | 4.5 | 2020 | 0.72 |

Thus, the present invention discloses that a loading direction that is applied by mechanical load or by thermal gradient along the central axis of the magnet will force the AGG direction to align in the same direction, which will result in a dramatic improvement in alignment of the easy axis direction throughout the magnet volume. The impact on magnetic properties of this microstructural alignment will be a significant increase in the squareness of the second quadrant of the hysteresis loop and an increase in the useful coercivity of the magnet for motor operation.

Although embodiments of the invention are described above with respect to producing a preferred orientation in the alnico type magnet shapes, other embodiments of the invention envision producing substantially single crystal magnet shapes in the alnico alloy system, or even in other alloy systems. For example, in FIGS. 10, 12, and 14, continuance of the AGG process for a longer time and/or using adjusted temperature and load parameters can produce a single crystal microstructure with a preferred orientation in the magnet shape, with an epitaxial seed attached to the magnet shape, as in Example 4 or without such a seed, as in Examples 1-3. This aspect of the AGG process, with or without grain rotation, can be applied as well to other alloy systems that have a cubic crystal structure other than body centered cubic to produce a single crystal shape or body. In particular, an exemplary alloy system to this end would include, but not be limited, to nickel alloys having a face centered cubic crystal structure, such as nickel based superalloys, to yield single crystal nickel-based alloy components for gas turbine engines.

REFERENCES, WHICH ARE INCORPORATED HEREIN BY REFERENCE

[1] I. E. Anderson, D. Byrd, J. Meyer. Highly tuned gas atomization for controlled preparation of coarse powder. Hochleistungsgasverdüsung für die gezielte Präparation grober Pulver, Materialwiss. Werkstofftech. 41 (2010) 504-512.

[2] C. B. Madeline Durand-Charre, Jean-Pierre Lagarde. Relation Between Magnetic Properties And Crystallographic Texture Of Columnar Alnico 8 Permanent Magnets, IEEE Transactions on Magnetics 14 (1978).

[3] N. Makino, Y. Kimura. Techniques to Achieve Texture in Permanent Magnet Alloy Systems, J. Appl. Phys. 36 (1965) 1185.

[4] W. F. Hosford. Mechanical Behavior of Materials, Cambridge University Press, 2009.

[5] A. Higuchi, T. Miyamoto. SOME RELATIONSHIPS BETWEEN CRYSTAL TEXTURES AND MAGNETIC PROPERTIES OF ALNICO-8, Ieee Transactions on Magnetics MAG6 (1970) 218-&.

[6] U.S. Pat. No. 5,125,574

[7] U.S. Pat. No. 5,372,629

[8] U.S. Pat. No. 5,589,199

[9] U.S. Pat. No. 5,811,187

Although the present invention has been described with respect to certain illustrative embodiments, those skilled in the art will appreciate that changes and modifications can be made therein within the scope of the invention as set forth in the appended claims.

We claim:

1. A sintered anisotropic magnet having essentially full density of at least 98% of theoretical and having a cubic polycrystalline microstructure, said magnet having been sintered under mechanical load without an applied exterior magnetic field to have controlled stress-biased grain alignment preference toward a <001> crystallographic direction wherein at least one enlarged grain is present as a result of solid state grain growth in a normal direction to applied longitudinal stress during sintering.

2. The magnet of claim 1 wherein the grain alignment preference is within 15 degrees of the <001> crystallographic direction.

3. The magnet of claim 1 whose microstructure includes a majority of grains that are enlarged and oriented toward the <001> crystallographic direction as compared to residual equiaxed, randomly-oriented grains.

4. The magnet of claim 2 wherein the at least one enlarged grain has a dimension of a millimeter or more in the normal direction.

5. The magnet of claim 1 comprising, in weight %, about 7 to about 8% Al, about 13 to about 15% Ni, about 24 to 42% Co, up to 3% Cu, up to about 8% Ti, and balance Fe and incidental impurities.

6. The magnet of claim 1 comprising sintered alnico pre-alloyed particulates.

7. The magnet of claim 5 wherein the pre-alloyed particulates are gas atomized particles.

8. The magnet of claim 5 wherein the polycrystalline microstructure is substantially devoid of gamma phase at grain boundaries.

9. The magnet of claim 1 comprising Alnico 8 alloy fully heat treated (FHT) after sintering to exhibit a remanence $B_r$ of at least 8523 G.

10. The FHT magnet of claim 8 having a remanence $B_r$ of at least 9725 G.

11. The FHT magnet of claim 9 having a remanence ratio (Mr/Ms) of at least 0.83.

12. The FHT magnet of claim 8 having a BHmax of at least 6.4 MGOe.

13. A sintered anisotropic magnet having essentially full density of at least 98% of theoretical and having a cubic crystalline microstructure with a controlled grain alignment preference provided by at least one enlarged grain grown in response to applied longitudinal stress without an exterior magnetic field and prior to magnetic annealing so as to extend in a direction normal to a longitudinal axis of the magnet microstructure and oriented toward a <001> crystallographic direction, said at least one enlarged grain being enlarged as compared to residual randomly-oriented equiaxed grains in the microstructure.

* * * * *